US006309097B1

(12) United States Patent
Pengkuson et al.

(10) Patent No.: US 6,309,097 B1
(45) Date of Patent: Oct. 30, 2001

(54) DIE COATING MATERIAL STIRRING MACHINE

(75) Inventors: Somchai Pengkuson; Jom Petkra; Nipon Wongsarakham, all of Phatumthani (TH)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/492,600

(22) Filed: Jan. 27, 2000

(51) Int. Cl.[7] ..... B01F 7/20
(52) U.S. Cl. ..... 366/286; 366/325.4; 366/348
(58) Field of Search ..... 366/285, 286, 366/325.4, 325.5, 325.7, 325.8, 325.9, 348

(56) References Cited

U.S. PATENT DOCUMENTS 468,844 * 2/1892 Sullins .
4,175,875 * 11/1979 Van Horbek .
4,923,908 * 5/1990 Lostumo et al. .
5,549,384 * 8/1996 Reynolds .
5,739,582 * 4/1998 ElHatem et al. .

* cited by examiner

*Primary Examiner*—Tony G. Soohoo
*Assistant Examiner*—David Sorkin
(74) *Attorney, Agent, or Firm*—Duane, Morris & Heckscher LLP

(57) ABSTRACT

A stirring machine and method for automated mixing of multi-part encapsulants used for coating microelectronic devices such as integrated circuits. The stirring machine includes a variable speed motor; a stirring rod coupled to an output shaft of the motor; a lead screw for vertical adjustment of the stirring rod; a stirring head secured to the stirring rod, the stirring head including at least two spaced apart arms, each of the arms being radially equidistant form the axis of rotation; and a control system for varying the rotational rate and height of the stirring head and the duration of stirring. The stirring machine and method significantly reduce the amount of air entrained in encapsulants in accordance with existing manual methods of production, thereby reducing the time required for de-airing encapsulants.

9 Claims, 3 Drawing Sheets

DIE COATING MATERIAL STIRRING MACHINE

FIELD OF THE INVENTION

The invention relates generally to encapsulants for microelectronic devices, and more particularly to a device for mixing multi-part encapsulants to ensure a homogeneous mixture.

DESCRIPTION OF THE RELATED ART

Encapsulants such as silicone encapsulants used for sealing, protecting and preserving microelectronic devices are well known. Typically, encapsulants are formed by thoroughly mixing two component parts (i.e., a base and a curing agent) followed by a vacuum de-airing to release entrained air bubbles entrained in the mixture. Following the de-airing process the encapsulant is dispensed on a device and finally cured.

Encapsulants prepared by manual stirring are subject to excessive air entrapment. Before these encapsulants can be used for coating dies and other devices, they must be de-aired to remove unwanted air bubbles. A typical de-airing procedure is a two-step process in which a mixture is first vacuum de-aired for up to 30 minutes, followed by a standing period of 5 to 10 minutes to allow any remaining small surface bubbles to dissipate. Thus, the total time required for de-airing may average about 40 minutes.

In addition, when encapsulant components are combined manually, it is difficult to consistently obtain homogeneous mixtures. Variations in mixing times, stirring speeds and stirring techniques are known to produce non-homogeneous materials. When a nonconforming material is used to coat a device such as an integrated circuit, the coating may not completely cure. If the coating fails to completely cure, the entire integrated circuit must be scrapped.

Accordingly, it is desirable to provide improved apparatus and methods for mixing encapsulants for microelectronic devices. The preferred device and method would provide a homogeneous encapsulant with minimal entrainment of air bubbles.

SUMMARY OF THE INVENTION

The invention provides a stirring machine and method for mixing encapsulants. The stirring machine includes a variable speed motor; a stirring rod coupled to an output shaft of the motor; a lead screw for vertical adjustment of the stirring rod; a stirring head secured to the stirring rod, the stirring head including at least two spaced apart arms, each of the arms being radially equidistant form the axis of rotation; and a control system for varying the rotational rate and height of the stirring head and the duration of stirring.

BRIEF DESCRIPTION OF THE DRAWINGS

These and other features and advantages of the invention are more fully disclosed or rendered apparent from the following description of certain preferred embodiments of the invention, that are to be considered together with the accompanying drawings wherein like numbers refer to like parts and further wherein.

DETAILED DESCRIPTION

Methods for forming encapsulated devices are well known. As an example, U.S. Pat. No. 4,017,495 to Jaffe et al., herein incorporated by reference, discloses apparatus and methods for forming encapsulated integrated circuit devices. Other types of circuit packages using other types of electrical connections may be formed in accordance with the encapsulant material formed by the exemplary method disclosed herein.

The present invention is directed to stirring machine and method for automated mixing of multi-part encapsulants used for coating microelectronic devices such as integrated circuits. A stirring machine in accordance with the invention provides for timed mixing cycles performed at predetermined rates to ensure consistent mixing and catalyzation of encapsulants. The stirring machine also reduces the time required to prepare encapsulants by minimizing the entrainment of air in encapsulants, thereby shortening de-airing cycles.

Figure 1:
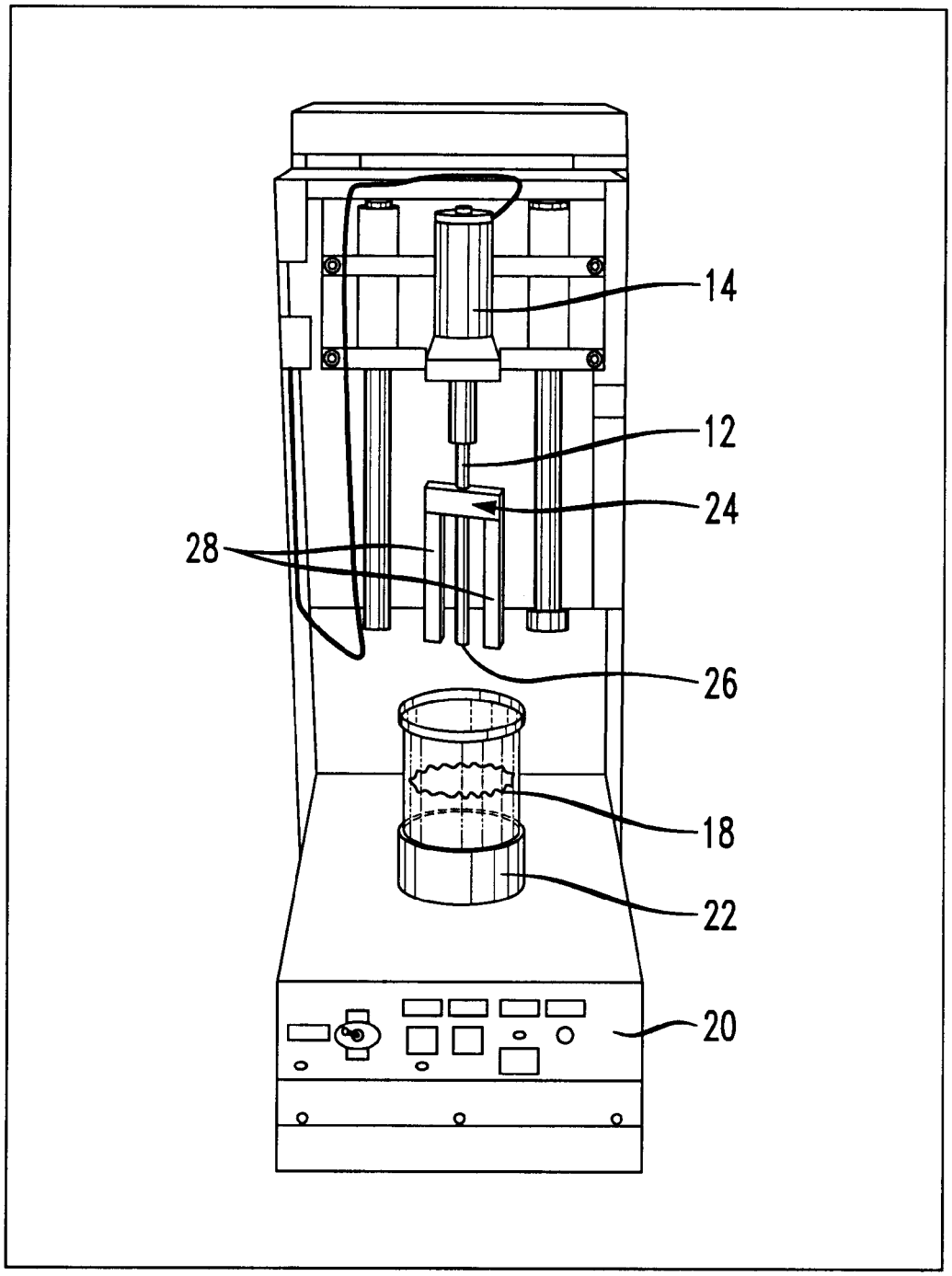
FIG. 1. is a perspective view of a die coating stirring machine in accordance with the invention, shown with the stirring rod retracted from the beaker.
Figure 2:
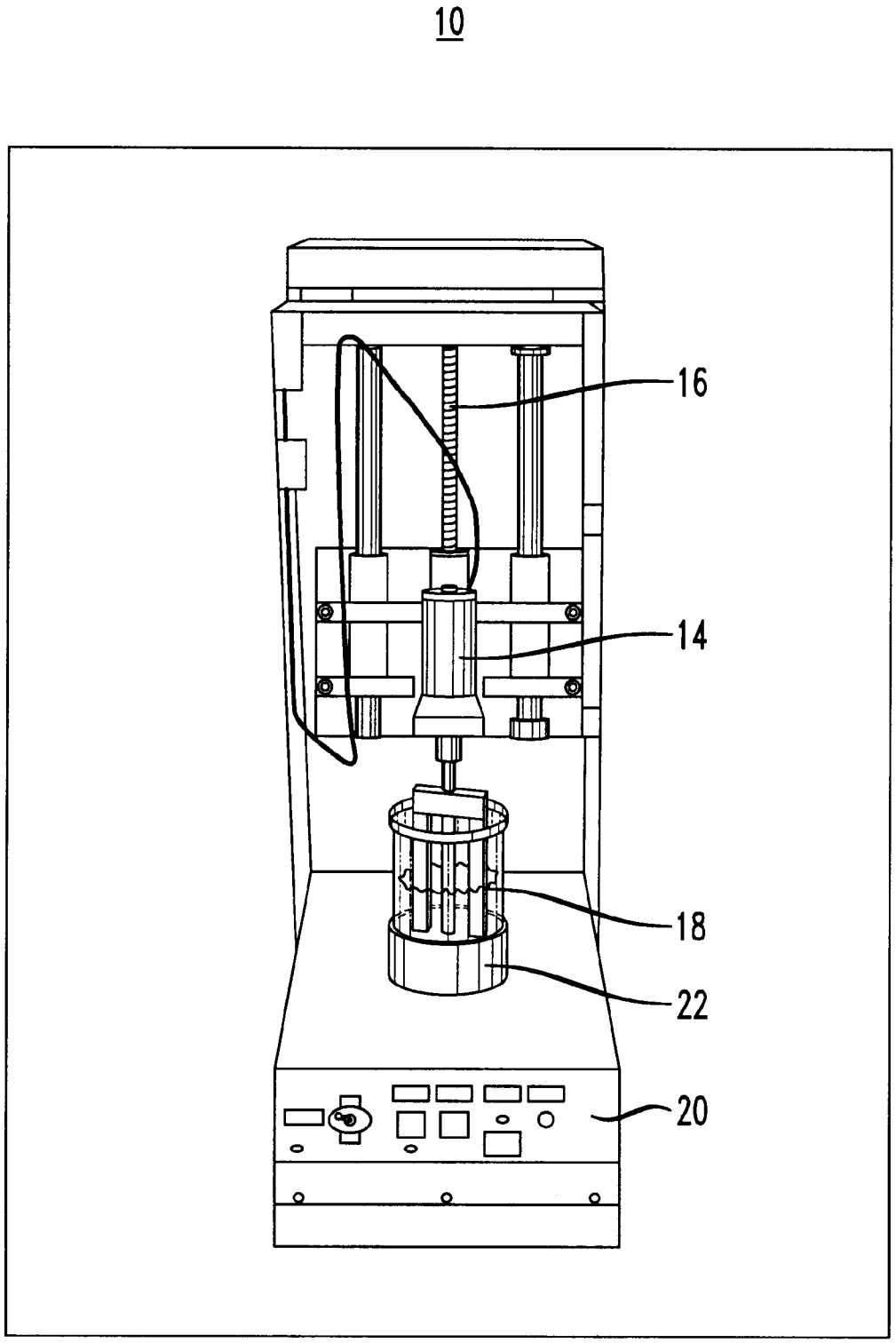
FIG. 2 is a perspective view of the die coating stirring machine shown in FIG. 1, with the stirring rod inserted in the beaker.

FIG. 1 shows a stirring machine 10, in accordance with the invention. The stirring machine 10 includes a stirring rod 12 mounted to the output shaft of a variable speed motor 14. The motor 14 and rod 12 are vertically adjustable by virtue of a lead screw 16. A stirring head 24 is provided at the lower end of the stirring rod 12. A glass beaker 18 serves as a receptacle for receiving and mixing the component parts of the encapsulant. The beaker 18 is positioned on a stirring pad 22 which is used to align the beaker 18 with the stirring head. A control system 20 coupled to motor 14 allows for selective speed control and timed mixing cycles.

Figure 3:
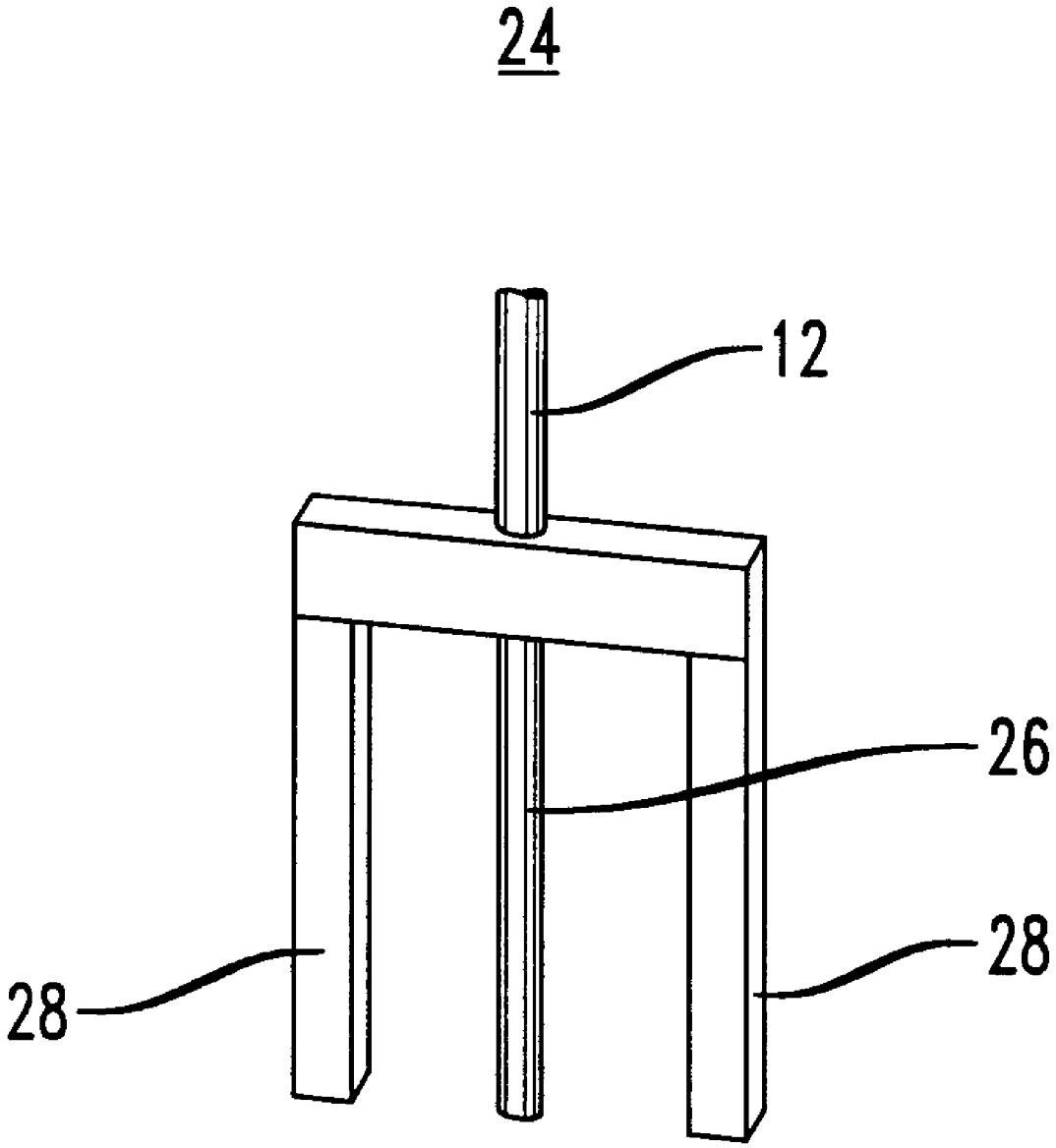
FIG. 3 is a detailed perspective view of the stirring head, forming part of the die coating stirring machine shown in FIG. 1.

Referring to FIG. 3, the exemplary embodiment of stirring head 24 includes a central disposed spindle 26 which depends from, and is axially aligned with, stirring rod 12. The stirring head 24 further includes a pair of laterally spaced stirring arms 28 which are coplanar, parallel and coextensive with spindle 26. Stirring arms 26 located on opposite sides of spindle 26, and are radially equidistant therefrom.

The stirring machine 10 may be programmed to provide timed mixing cycles at predetermined stirring speeds to ensure uniformity and homogeneity throughout successive batch productions. Parameters such as stirring speed, stirring time and stir head position may be preprogrammed to reduce the possibility of human input error.

Acceptable results were achieved using a stirring machine 10, in accordance with the invention, to prepare a two-part silicone epoxy encapsulant as follows. A two-component solventless silicone gel for sealing and protecting microelectronic devices known as HIPEC®Q3-6646, available from Dow Chemical Corporation in Midland, Michigan, was used. The two components were placed in a glass beaker in a 1:1 ratio. The components had a total combined volume of about 20 ml. The beaker was then placed on the stirring pad 22 of stirring machine 10, where the components were mixed using a spindle speed of approximately 1,200 rpm for about five minutes. The mixture was then left to stand for approximately 15 minutes to de-air in the mixture.

A number of advantages in accordance with the invention. The amount of air entrained in the mixture is substantially reduced as compared to prior known techniques, including hand mixing operations. Consequently, the time required to remove air bubbles introduced to the mixture is significantly reduced. While manual stirring techniques require a vacuum de-airing procedure lasting up to 30 minutes, followed by a standing period of 5 to 10 minutes, the present technique provides for de-airing in a total time of about 15 minutes. In addition, the automated mixing ensures consistently homogeneous mixture, thereby avoiding incomplete cure problems associated with nonhomogeneous mixtures. Finally, the stirring head and beaker are easily cleaned by charging the beaker with a manufacturers recommended solvent and cycling the stirring head in the solvent after each batch is completed.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A method of forming a die coating comprising the steps of:

combining the components of a two part epoxy encapsulant in a container;

stirring the components using a stirring machine to form a mixture, the machine having a variable speed motor, a stirring rod coupled to an output shaft of the motor, a lead screw for vertical adjustment of the stirring rod, a stirring head secured to the stirring rod, the stirring head including at least two spaced apart arms and a spindle, said arms being substantially coplanar with said spindle, each of the arms being radially equidistant from an axis of rotation, and a control system for varying the rotational rate and height of the stirring head and the duration of stirring; and de-airing the mixture at substantially atmospheric pressure.

2. The method of claim 1 wherein the encapsulant is a silicone encapsulant.

3. The method of claim 1 wherein the at least two arms and the spindle are substantially coextensive along an axis of rotation.

4. The method of claim 1 wherein the stirring head includes an impeller base which extends radially from an axis of rotation, and the at least two spaced apart arms extend axially from the impeller base.

5. The method of claim 4 wherein the at least two spaced apart arms each have a free end.

6. The method of claim 4 wherein the at least two spaced apart arms comprise rectangular bars.

7. The method of claim 3 wherein a cross-sectional area of each of the at least two arms is substantially equal to a cross sectional are of the spindle.

8. The method of claim 1 wherein the step of de-airing the mixture comprises allowing the mixture to stand for about 15 minutes.

9. The method of claim 1 wherein the step of stirring the components comprises stirring the components using a stirring head speed of about 1200 rpm for about five minutes.

* * * * *